US010689155B2

(12) United States Patent
Sullivan

(10) Patent No.: US 10,689,155 B2
(45) Date of Patent: Jun. 23, 2020

(54) MODULAR STORAGE CONTAINER SYSTEM

(71) Applicant: Lyno Lewis Sullivan, Woodbury, MN (US)

(72) Inventor: Lyno Lewis Sullivan, Woodbury, MN (US)

( * ) Notice: Subject to any disclaimer, the term of this patent is extended or adjusted under 35 U.S.C. 154(b) by 0 days.

(21) Appl. No.: 15/435,257

(22) Filed: Feb. 16, 2017

(65) Prior Publication Data

US 2018/0186511 A1 Jul. 5, 2018

Related U.S. Application Data

(60) Provisional application No. 62/441,504, filed on Jan. 2, 2017.

(51) Int. Cl.

| | |
|---|---|
| ***B65D 21/02*** | (2006.01) |
| ***B65D 21/08*** | (2006.01) |
| ***B65D 6/24*** | (2006.01) |
| ***B65D 6/26*** | (2006.01) |
| ***B65D 6/16*** | (2006.01) |

(52) U.S. Cl.

CPC ..... *B65D 21/0204* (2013.01); *B65D 7/24* (2013.01); *B65D 7/32* (2013.01); *B65D 9/12* (2013.01); *B65D 9/24* (2013.01); *B65D 11/1873* (2013.01); *B65D 21/02* (2013.01); *B65D 21/083* (2013.01)

(58) Field of Classification Search

CPC ..... B65D 21/0204; B65D 7/24; B65D 9/24; B65D 9/12; B65D 7/32; B65D 21/02; B65D 11/1873; B65D 21/083

See application file for complete search history.

(56) References Cited

U.S. PATENT DOCUMENTS

| | | | | |
|---|---|---|---|---|
| 695,677 | A | 3/1902 | Faris | |
| 941,013 | A | 11/1909 | Wheaton | |
| 1,198,524 | A | 9/1916 | Cunliffe | |
| 1,312,403 | A | 8/1919 | Kenyon | |
| 2,024,075 | A | 4/1935 | Swaim | |
| 2,919,045 | A | 12/1955 | Waugh et al. | |
| 3,044,656 | A * | 7/1962 | Dobbie | B65D 88/12 220/4.28 |
| 3,246,828 | A | 8/1963 | Branscum et al. | |
| 3,138,398 | A | 6/1964 | Silverman | |
| 3,955,702 | A * | 5/1976 | Lundy | F21S 8/088 220/4.28 |
| 3,966,285 | A * | 6/1976 | Porch | B65D 7/24 312/265.4 |
| 4,012,153 | A | 3/1977 | Pidgeon et al. | |
| D278,110 | S | 3/1985 | Boland, II | |
| 4,558,797 | A | 12/1985 | Mitchell | |
| 4,574,955 | A * | 3/1986 | Camossi | B65D 81/07 206/386 |
| D334,815 | S | 4/1993 | Bunger | |

(Continued)

FOREIGN PATENT DOCUMENTS

| | | |
|---|---|---|
| DE | 0144916 | 7/1901 |
| DE | 19652343 A1 | 6/1989 |

*Primary Examiner* — Kareen K Thomas

(74) *Attorney, Agent, or Firm* — Berggren Law Office, LLC; William R Berggren

(57) ABSTRACT

Provided is a modular storage container system, kit, and method of using that includes standardized panels, joining protrusions, rods and corner blocks to form a durable multi-functional modular storage.

19 Claims, 15 Drawing Sheets

(56) References Cited

U.S. PATENT DOCUMENTS

| | | | | |
|---|---|---|---|---|
| 5,245,838 | A | 9/1993 | Cavalea | |
| 5,502,708 | A | 3/1996 | Morimoto | |
| 5,655,662 | A * | 8/1997 | Garcia | B65D 81/07 206/583 |
| 6,010,021 | A | 1/2000 | Zuidam et al. | |
| 6,216,899 | B1 | 4/2001 | Vicari | |
| 6,289,684 | B1 | 9/2001 | Guidry, II et al. | |
| 6,631,821 | B2 * | 10/2003 | Vourganas | B65D 19/18 206/600 |
| 7,478,734 | B2 | 1/2009 | Vargas | |
| 7,827,940 | B2 | 11/2010 | Silverman | |

* cited by examiner

MODULAR STORAGE CONTAINER SYSTEM

RELATED APPLICATIONS

This application is a utility application that claims priority to U.S. Provisional Application Ser. No. 62/441,504, filed Jan. 2, 2017, the contents of which are herein incorporated by reference in their entirety.

FIELD OF THE INVENTION

This application relates to modular storage containers and systems that are efficient and efficacious for the transportation and long term storage of goods.

BACKGROUND

Uniform shipping containers have been in commercial use for decades. These are generally meant for the transporting of goods between seaports and along rail road lines. Additionally, these containers can be used for storing good. The uniform size of shipping containers can allow for void-free stacking minimizing the space needed on transports or in storage lockers. Shipping containers can be shipped completely ready for use or the parts for a shipping container can be made in a factory, shipped to a use location, and then assembled to form a shipping container.

Collapsible and foldable shipping cases or containers are known. They can be designed to contain heavy and bulky loads of goods for shipment. These containers are, typically, made of wood and have added hinges to hold the sides and top together. Multiple containers can be stacked and placed upon a transportation platform such as the deck of a ship, the bed of a trailer truck, or a flat-bed rail car.

SUMMARY OF THE INVENTION

There is a need for storage containers that are lightweight, strong, modular, and can be stacked vertically or horizontally or nested internally to one another to provide a storage and shipping system. There is also a need for storage containers that can be made economically and from parts that are interchangeable and/or can be sold as a packaged kit for later assembly. There is also a need for varying sizes utilizing similar assembly methods. There is also a need for storage containers that include a multitude of modular storages that are easily assembled, customizable, sturdy, and of commercial size.

In one aspect, a modular storage container system is provided that includes one or more modular storage containers. Each container includes a multitude of panels. Each panel can include edges with notched ends and at least one edge of each panel includes joining elements. In some embodiments, the joining elements can be an array of male joining protrusions and female receptacles arranged along that edge. Each male joining structure has an orifice and the array of male joining protrusions and female receptacles on the edge of each panel can be interlaced with an array of complimentary female receptacles and male joining protrusions of an adjacent edge of an adjacent panel. The provided modular storage container system also includes a multitude of rods slideably engaged through the orifices of the joining elements and at least partially engaging corner blocks. Additionally, the provided modular storage container system includes a corner block with holes through adjacent faces that is configured to attach to the ends of the rods slideably engaged through adjoining panels in a perpendicular alignment with each other.

In another aspect, a kit is provided that includes at least six panels. Each panel includes edges with joining elements. In some embodiments, the panels can have notched ends. In some embodiments, the joining elements can be an array of male joining protrusions and female receptacles arranged along that edge. Each male joining structure can have an orifice and the array of male joining protrusions and female receptacles on the edge of each panel can be interlaced with an array of complimentary female receptacles and male joining protrusions of an adjacent edge of an adjacent panel. At least twelve rods are configured to be slideably engaged through the orifices of the interlaced male joining protrusions of adjacent panels. At least eight corner blocks with holes through adjacent faces are configured to attach to the ends of the rods joining adjacent panels in a perpendicular alignment with each other.

In yet another aspect, a method of using a modular storage container system is provided that includes providing a modular storage system. The storage system includes one or more modular storage containers, each modular storage container including a multitude of panels, each panel having edges that include joining elements. In some embodiments, the panels can have notched ends. In some embodiments, the joining elements can include an array of male joining protrusions and female receptacles arranged along that edge. Each male joining structure has an orifice. The storage system also includes a multitude of rods threaded through the orifices of the interlaced male joining protrusions of adjacent panels. Finally, the storage system also includes a corner block that includes a corner block with holes through adjacent faces configured to attach to the ends of the rods joining adjacent panels in a perpendicular alignment with each other. The provided method includes assembling the modular storage system into a storage assembly.

In this application, the term, "chamfer" or "chamfered" refers to edges that are cut (usually at 45 degrees) to allow them to be assembled perpendicularly with adjoining chamfered edges to make a perfect right angle;

the term, "congruent" refers to objects which can be exactly superimposed upon each other;

the term, "connected" means affixed permanently, affixed temporarily, or in contact with;

the term, "lock in" refers to shorter rods that are held into position by longer rods intersecting the shorter rods on each end, or end caps;

the term, "modular" refers to standardized units that can be used to construction storage containers or storage container systems;

the term, "rectangular polyhedron" refers to solid figures that have six plane faces that are either parallel to or perpendicular to each other; and the term, "set screw elements" refer to screws generally used to secure an object against another type of object.

The provided modular storage container systems, kits, and methods of using fulfill the need for lightweight, strong, modular storage containers that can be stacked vertically or horizontally on a transportation vehicle or in a storage location. The provided modular storage container systems, kits, and methods of using are economical, made from interchangeable parts, and can be sold as a packaged kit for later assembly. These storage container systems, kits and methods can be easily assembled, are customizable, sturdy and can be of any size, including commercial size.

The details of one or more embodiments are set forth in the accompanying drawings and description below. Other features, objects, and advantages will be apparent from the description and drawings, and from the claims.

BRIEF DESCRIPTION OF THE DRAWINGS

FIG. 8A is an illustration of the frame without any panels and FIG. 8B has one panel (the floor panel, in this case) installed.

DETAILED DESCRIPTION

Figure 1:
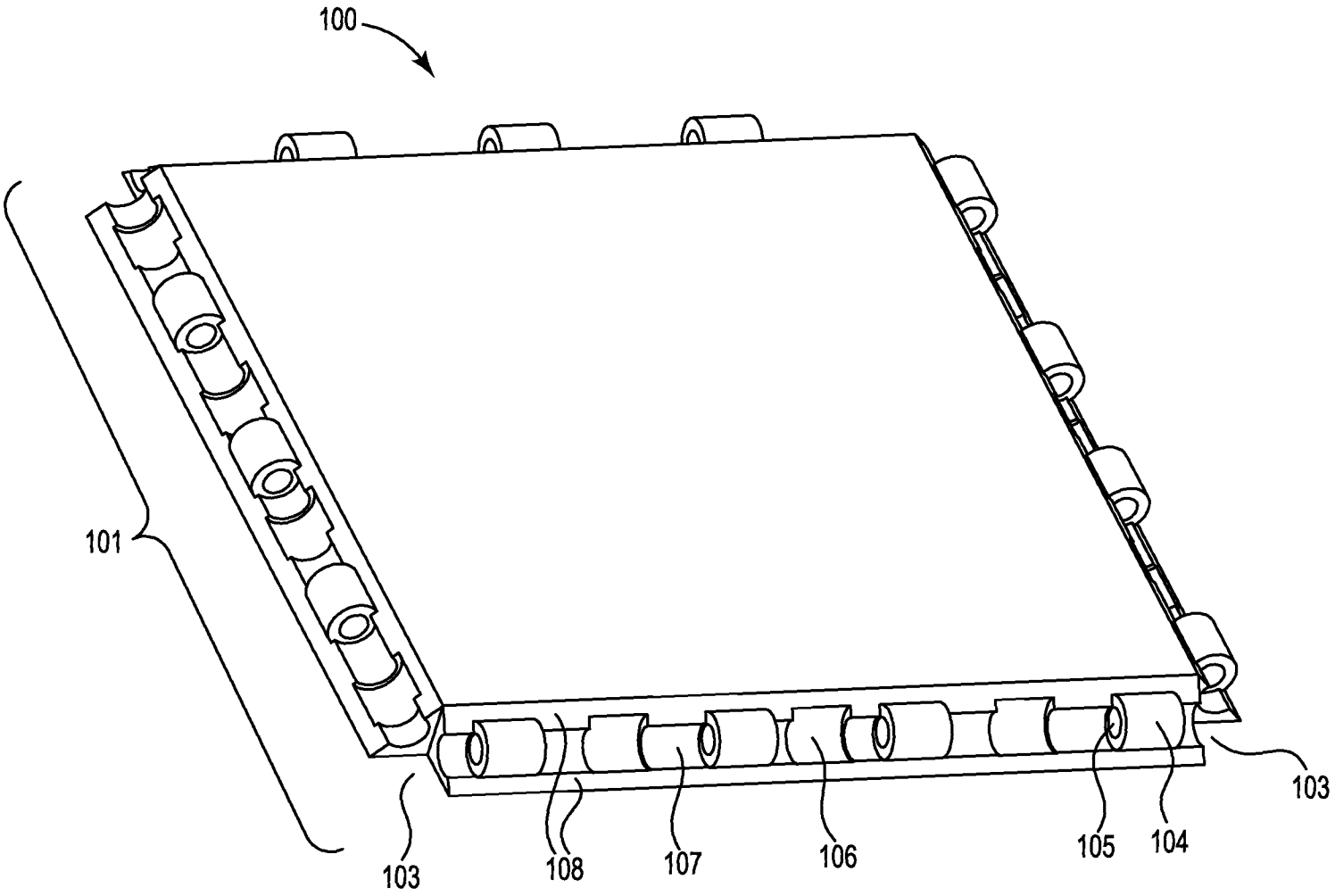
FIG. 1 is an illustration of a panel from an embodiment of a provided modular storage container.

In the following description it is to be understood that other embodiments are contemplated and may be made without departing from the scope or spirit of the present invention. The following detailed description, therefore, is not to be taken in a limiting sense.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein. The use of numerical ranges by endpoints includes all numbers within that range (e.g. 1 to 5 includes 1, 1.5, 2, 2.75, 3, 3.80, 4, and 5) and any range within that range.

A modular storage container system is provided that includes one or more modular storage containers with each modular storage container including a multitude of panels. Each panel can have at least one edge with notched ends. The panels can be solid or can be a frame into which panel inserts can be mounted. In some embodiments, the panels or panel inserts can include window, doors, or other openings. The solid panels can have at least one side that is completely planar—with no depressions or protrusions. In other embodiments, the solid panels can have some topography that can include, for example, patterns, logos, words, or any other design that includes features above or below the plane of the panel. Typically, the panels have a substantially flat, coplanar outer surface so that they are potentially stackable. The panels can all be congruent or can have different dimensions. Typically, the panels are assembled to form storage containers that are either cubic (same dimensions on all six sides) or in the shape of a rectangular polyhedron (two different dimensions among the six panels) although other arrangements are possible. The size (length and width) of the panels can be any useful size. In some embodiments, the length and width of the panels can be from about 1 m, from about 2 m, from about 3 m, or even more. When the panels are congruent and used to form a cubic structure they can, typically, be 2.34 m in length and width. The panels can also have a thickness. Panel thickness can vary from up to 2.5 cm to about 10 cm, or even more. When the panel length and width are 233.6 cm (7 feet, 8 inches) and the panel thickness is 10.16 cm (4 inches), then a container can be formed that has an inner dimension of 84 $cm^3$ (or seven feet cubed).

The provided panels can be made of any materials that can withstand the weight and force used in stacking the provided modular storage container. Typically, they can be made of wood, metal, plastic, composite, honeycomb tessellations, 3D vibration dampening scaffolding, insulation foam filling, acoustic filling materials, and liquid containment cavities. In some embodiments, the panels can be made of two or more materials fastened together using bolts, welds, glue, clamps, snap clamps, heat, pressure, vulcanization, laser, rivets, forging, crimping, casting, snap fittings, interlocking fittings. Other well-known fastening means can be used as well. The provided panels can include edges with notched ends wherein at least one edge of each panel includes joining elements. In some embodiments the joining elements can be an array of male joining protrusions, each having an orifice therethrough, and female receptacles arranged along that edge. The array of male joining protrusions and/or female receptacles can be made of different materials that are connected to the main body of the panel. The male joining protrusions can include hinges, knuckle halves of piano hinges, barrel hinges, butt hinges, pivot hinges, strap hinges, snap clamps, clips, and hooks. Female receptacles can include depressions into which male joining protrusions on adjacent panel edges can fit. They can be a cavity or an added element containing a cavity. In some embodiments, the protrusions and receptacles can part of the panel. For example, the panels including the edges with protrusions and receptacles can be injection molded as a single piece from a mold, 3D printing, or vacuum forming. Typical materials or use in vacuum forming are conventionally thermoplastics. The most common and easiest to use thermoplastic is high impact polystyrene sheeting (HIPS). In some embodiments, the joining elements can be an extended part of the panel.

Each joining structure includes an orifice through which a rod can be slideably engaged. In some embodiments, the orifice can be a through hole. In other embodiments the orifice can be a knuckle halves of hinges that can contain and hold the rod. Examples of such hinges include piano hinges, snap clamps, and door hinges. In some embodiments, the joining structure can include male joining protrusions and female receptacles, both on each edge. The male joining protrusions and the female receptacles on the edge of each panel can arranged on at least one edge of the panel in any pattern however, typically, they are alternated along the edge so that all panels can be congruent (in the case of a cubic structure) or several panels can be congruent (in the case of a rectangular polyhedral structure) thereby reducing the cost and the number of parts needed.

The array of male joining protrusions and female receptacles on the edge of each panel can be interlaced with a complimentary array of female receptacles and male joining protrusions on the edge of an adjacent panel. This arrangement is illustrated and shown in the figures. Typically, these interlaced arrays allow for a rod to be inserted through the orifices of the male protruding parts of both adjacent panels since there are male protruding parts from each of the two adjacent panels represented in the interlaced array of edges. This is similar to a standard door hinge. However, other arrangements that allow for the same adjoining of adjacent panels are within the scope of this disclosure.

Adjacent panels of the one or more modular storage containers can be joined by slideably engaging rods through the orifices of the interlaced male joining protrusions of adjacent panels after they are adjoined. The rods can be of any shape (cross-section). In some embodiments, they can have a cross-section that is circular such as those used in a door hinge. Rods with circular cross-sections allow for the free rotation of the adjoined panels that can make it easier to adjoin additional panels to assemble the modular storage container. Alternatively, the rods can have other cross-sections such as polygonal cross-sections. Examples of such cross sections can include triangles, squares, pentagons, hexagons or other more complicated structures. All of these rods can be utilized if they can fit through the combined orifices of adjoined edges of adjacent panels.

In some other embodiments, all of the panels can be congruent and have a rectangular outer surface. In this embodiment, the joining elements can be the protruding long ends of each panel. Each panel can include joining elements that are the overlapping ends of each of the rectangular panels. Each joining element can have an orifice (an elongated hole), that allows shorter rods and longer rods to protrude through each end.

In some embodiments, the orifices of the interlaced male joining protrusions can have a complementary shape to the rods. For example, if a rod has a square cross-section, the orifices can be in the shape of a square that can accommodate the similarly shaped rods. Some rods with non-circular cross-sections can be useful to lock adjoining panels into place adding rotational stability of the assembled modular storage container. However, the restriction of motion caused by these shapes can make assembly of the modular storage container much more difficult.

Typically, the rods are made of strong materials such as steel, iron, alloys, carbon-reinforced fiber, ceramics, or composite. The rods can be of any diameter but, in some embodiments can have diameters of at least 6 mm, of at least 30 mm, at least 60 mm, at least 120 mm, at least 180 mm, at least 250 mm, or even larger. The length of the rod depends upon the size of the finished storage container. Modular storage containers are contemplated that have sides needing rods of lengths of at least 2.0 cm, 0.3 m, at least 0.6 m, at least 1 m, at least 2 m, at least 3 m, or even larger.

The provided modular storage containers also include at least one corner block that has holes through adjacent faces. The holes are configured to engage the ends of rods joining adjacent panels in a substantially perpendicular alignment. In embodiments, of modular storage containers that are cubic in dimension, the containers can include at least twelve rods—four of each that are congruent and longer and eight of which are congruent and shorter. The longer rods can be used along vertical edges (sides) and the shorter rods can be used along horizontal edges (tops and bottoms). In some embodiments, the four vertical rods are longer than the eight horizontal rods. When assembling this cubic storage container, the eight horizontal rods can be partially inserted into holes in the respective corner blocks so that they are less than half way inserted through the holes. This allows the four longer vertical rods to be placed vertically through the same set of corner blocks and lock in the horizontal rods by blocking their motion through the corner block. In this configuration, if the assembled modular storage container is placed on a solid surface, gravity can lock the vertical rods in place.

In other embodiments, all of the rods can be congruent and can be locked into the corner block using cap elements. It is contemplated that plug elements can be placed on rods protruding through the corner blocks (such as the longer vertical rods) and hold them into place. Plug elements can also be inserted partially into each face of the corner blocks opposite the rods and secured to the corner block to lock them in. The caps can also include security elements such as locks, wires, pins, etc. The holes on the outside of the rods can be capped with a plug. In some embodiments, the plug can have a turning element such as male screw thread and the outer hole of the corner block can have a complementary turning element, a female thread, thus accommodating the plug. In some embodiments, a corner block can include a set screw through a threaded hole that can allow for securing rods engaged therethrough to the corner block.

In other embodiments, some of the rods can include threads and the inner holes of some or all of the corner blocks can include complimentary threads allowing the rods to be screwed into the corner blocks. This can be more easily facilitated if the screw direction on each end of a rod containing two screw threads are reverse threaded and complementary corner blocks are similarly accommodating allowing for the rods to be tightened in the corner blocks on both ends by turning the rod in one direction only.

In these embodiments, the array of male protrusions and female receptacles may need to have spaces allowing for the turning of the rods from the inside. In some embodiments, the last panel or panels can be attached to the modular storage container using an outer latching means since the inside of the container may be inaccessible after the last panel is sealed. However, the last panel can include a door or window to make the inside of the container accessible. Latching means can include locking hinges, welds, seals, slide bolts, drop bars, or snap clamps. Any other similar assemblies of the panels using rods that include screw elements are within the scope of this disclosure.

In some embodiments, at least one rod has male screw threads on at least one end and at least one corner block has at least one female screw thread. If the rods include threads on all of the ends, they can be screwed into corner blocks to form a solid cube or rectangular polygon framework. Such a framework can be built and then panels attached, for example, using snap-on clamps, straps, latches, or clips.

As stated earlier, the multitude of panels can be congruent to form a modular storage cube, can include two different types of panels which can be used to form a rectangular polyhedron, or can have any other shapes that allow for assembly and packing of the modular storage containers in minimal space. Each of the multitude of panels can have a notch at each end to allow for space taken up by an edge of each corner block. Typically, the corner blocks are cubes although other shapes are within the scope of this disclosure. In some embodiments, when assembled, the modular storage containers can have a completely flat face that is coplanar with the edges of the corner blocks. By substantially flat face it is meant that there are no protrusions on the side of the storage container that will prevent close packing of that storage container on the sides, bottom, or top. In some embodiments, at least two faces of a corner block engaged in the notched edges of two or more panels can be substantially co-planar with the panels of a regular cube or rectangular polyhedron.

In some embodiments, the provided modular storage container can include a panel that has a door or a window therewithin. In some embodiments, multiple storage containers in the shape of rectangular polyhedrons can be stacked together vertically and/or horizontally to form a storage assembly. The storage assembly can take up minimal space and can fit on the bed of a truck, on the bed of a flat rail car, in the cargo hold of a ship or plane, or in a storage location for later use. In some embodiments, two or more cubic or rectangular polyhedric storage modules can be co-assembled (in some embodiments, without the inner wall) to form a larger modular storage container that has larger length and width dimensions. In other embodiments, two or more cubic or rectangular polyhedric storage modules can be co-assembled, one atop the other, without the inner ceiling/floor panel to form a larger modular storage container that can accommodate tall objects.

In another aspect, a kit is provided that can have the parts for assembly into a provided modular storage container. The kit includes at least six panels. Each panel can be as described above and can include at least one edge having joining elements. In some embodiments, the joining elements can include an array of male joining protrusions and female receptors arranged along that edge. Each male joining structure can have an orifice and the array of male joining protrusions and female receptacles on the edge of each panel can be interlaced with an array of complimentary female receptacles and male joining protrusions of an adjacent edge of an adjacent panel. The kit can contain at least twelve rods configured to be slideably engaged through the orifices of the interlaced male joining protrusions of adjacent panels. The kit can also include at least eight corner blocks, each corner block including a three-dimensional shape that can have holes through adjacent faces. In some embodiments, the corner blocks can be cubic. The at least eight corner blocks can be configured to engage the ends of the rods joining adjacent panels in a substantially perpendicular alignment. In some embodiments, at least six panels are congruent and at least four congruent rods are longer than the other at least eight congruent rods.

In yet another aspect, a method of using a modular storage container system is provided that includes providing a modular storage system. The storage system includes one or more modular storage containers, each modular storage container including a multitude of panels, each panel having edges with notched ends. At least one edge of each panel includes joining elements. In some embodiments, the joining elements can include an array of male joining protrusions and female receptacles arranged along that edge. Each male joining structure has an orifice. The storage system also includes a multitude of rods threaded through the orifices of the interlaced male joining protrusions of adjacent panels. Finally, the storage system can also include a corner block that includes a corner block with holes through adjacent faces configured to attach to the ends of the rods joining adjacent panels in a perpendicular alignment with each other. The provided method includes assembling the modular storage system into a storage assembly. Assembling can include interlacing the array of male joining protrusions and female receptacles on adjacent edges of each panel, inserting rods through the orifices of each of the male joining protrusions at the edge of each panel, and inserting the ends of each rod in a corner block so as to form a rectangular polyhedron. A modular storage container system can be formed by stacking at least two modular storage containers to form a storage assembly.

Objects and advantages of this invention are further illustrated by the following figures, but the figures as illustrated should not be construed to unduly limit this invention.

FIG. 1 is an illustration of a panel from an embodiment of a provided modular storage container. In FIG. 1, panel 100 of a multitude of panels has four edges. Each edge includes array 101 of male joining protrusions 104 and female receptacles 106 arranged along each edge. Rod channel 107 extends the length of the edge and allows for passage of a rod during interconnection of panels. Male protrusions 104 include an orifice 105, in this embodiment a hole, through male protrusion 104. The end of each edge includes notches 103 at each intersection of edges. Male protrusions 104 and female receptacles 106 from an adjacent panel are interlaced when two panels are adjoined. Each edge is chamfered 108 so that two adjacent panels can fit substantially perpendicular to each other when their respective arrays of complementary male protrusions and female receptacles are engaged and interlaced.

Figure 2:
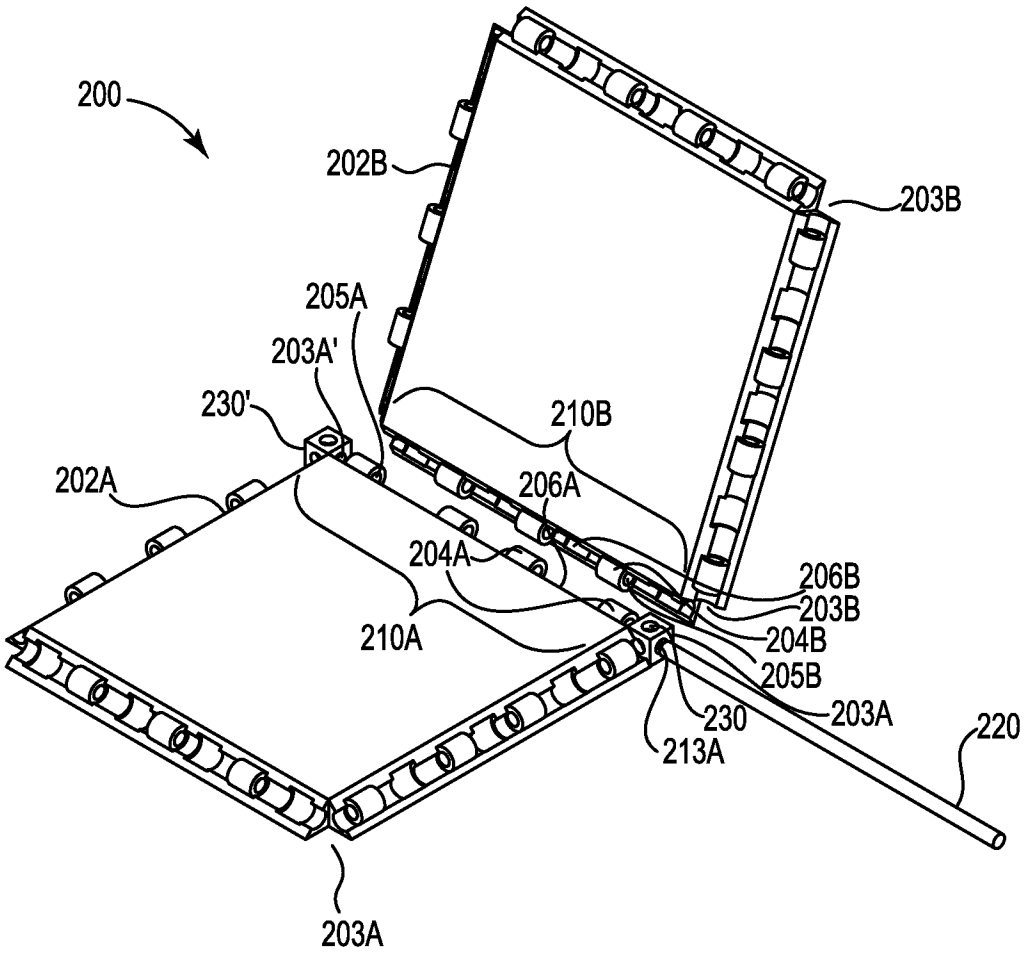
FIG. 2 is an exploded illustration of a partial embodiment of a provided storage container showing two congruent adjoining panels showing how the panels can be joined using a rod and two corner blocks.

FIG. 2 is an exploded illustration of a partial embodiment of a provided storage container showing two congruent adjoining panels showing how the panels can be joined using a rod and two corner blocks. Partial embodiment 200 shows two adjoining panels, 202A and 202B. Each panel includes arrays 210A and 210B on all edges (only one edge labeled on each panel in the drawing). Edges 210A and 210B include male protrusions 204A and 204B that include orifices 205A and 205B, respectively on adjacent edges to be joined. Corner block 230 is shown placed in notch 203A of panel 202A and notch 203B of panel 202B. When the illustrated edges of panel 210A and 210B are engaged, male protrusions 204A on panel 210A and 204B on panel 210B can be engaged into female receptacles 206B on panel 210B and 206A (hidden from view) on panel 210A. To join panels 202A and 202B, rod 220 is slideably engaged through hole 213A in corner block 230, through the orifices 205A and 205B in interlaced array 210A and 210B and through hole 203A' of corner block 230'. Additional panels can be adjoined to this structure to form a rectangular polyhedric modular storage container.

Figure 3:
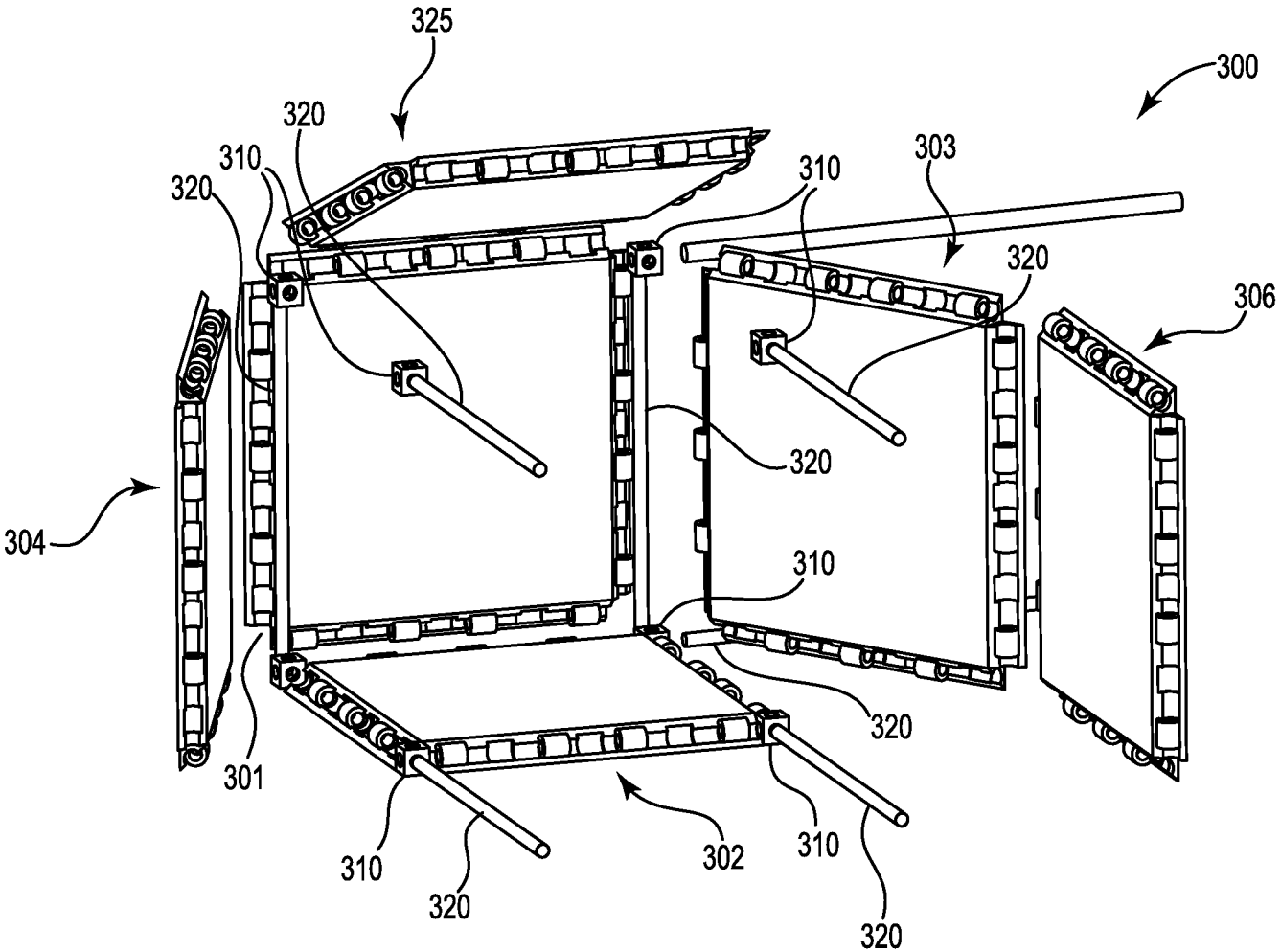
FIG. 3 is an exploded illustration of an embodiment of a provided modular storage system showing six congruent panels that includes twelve rods (only seven shown in figure) and eight corner blocks showing how the components can be assembled to form a cubic storage container.

FIG. 3 is an exploded illustration of an embodiment of a provided modular storage system 300 showing six congruent panels that includes twelve rods (only seven shown in figure) and eight corner blocks showing how the components can be assembled to form a cubic storage container. Six congruent panels 301-306 are shown in position for joining. Each panel has arrays of connecting structures as illustrated in more detail in FIG. 2. These six panels can be joined using eight corner blocks 310 and eight rods 320 (seven shown in FIG. 3).

Figure 4:
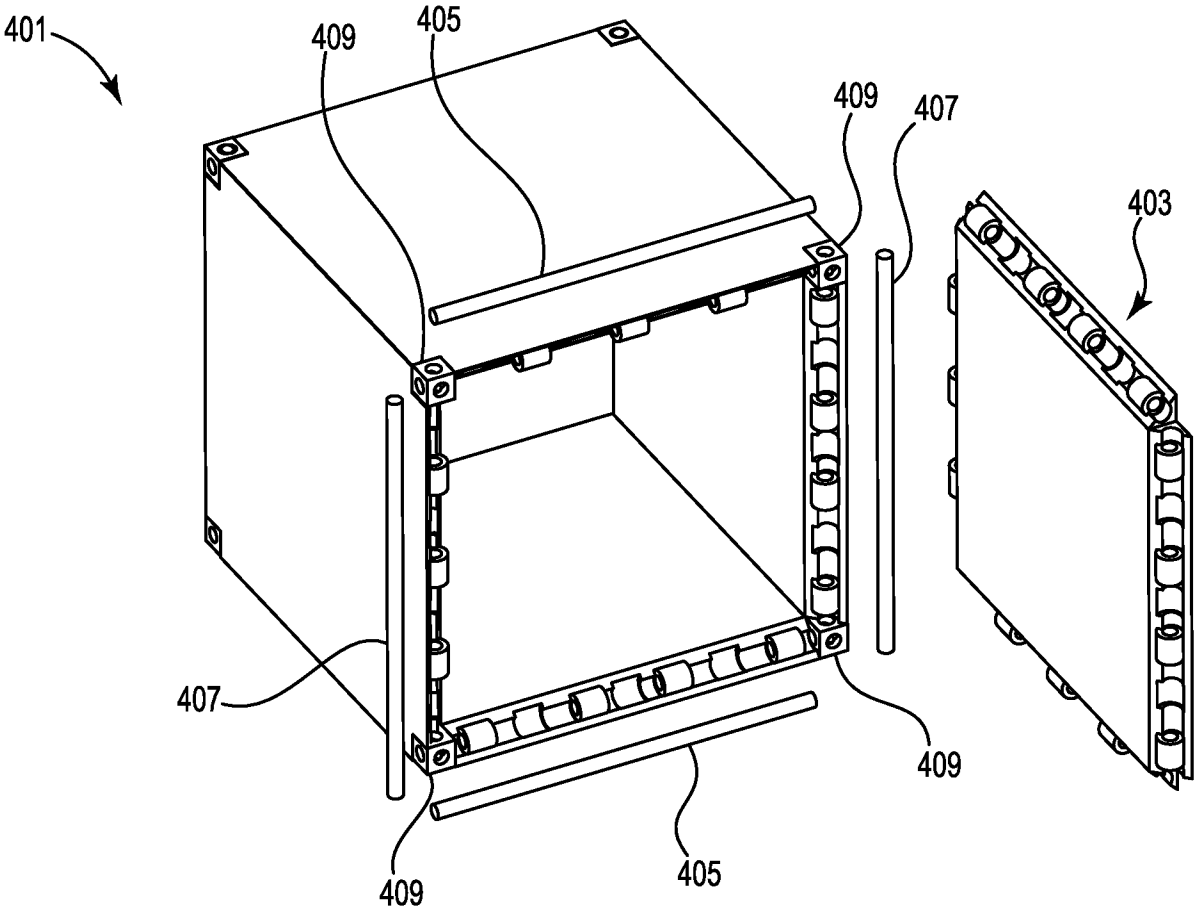
FIG. 4 is an illustration of the partially assembled storage container of FIG. 3 showing the last panel before it is assembled.

FIG. 4 is an illustration of the partially-assembled storage container of FIG. 3 showing the last panel before it is assembled. Partially-assembled storage container 401 is shown along with last panel 403. Four corner blocks 409 are shown in place in partially-assembled storage container 401. Last panel 403 can be engaged with partially-assembled storage container 401 as shown in FIGS. 1-3. After last panel 401 is engaged with all edges of partially-assembled storage container 401, short rods 405 can be inserted through corner blocks 409 and the aligned orifices of the interlaced male joining structures on two opposing sides (shown as top and bottom in FIG. 4). Short rods 405 can fit through all of orifices aligned along the edge and can be slideably engaged with the corner blocks 409 so that they enter holes of the corner blocks but are not inserted deep enough into the corner blocks so as to block the perpendicular holes of the corner blocks. Finally, longer rods 407 can be inserted into the other edges (both sides of FIG. 4). They extend to the outer ends of the corner blocks and therefore lock the shorter rods into place by their presence. Longer rods 407 can be locked into place by gravity against any surface they are vertically against. Alternatively, longer rods 407 can be secured to the completed finished box by other means such as pins or set screws.

Figure 5B:
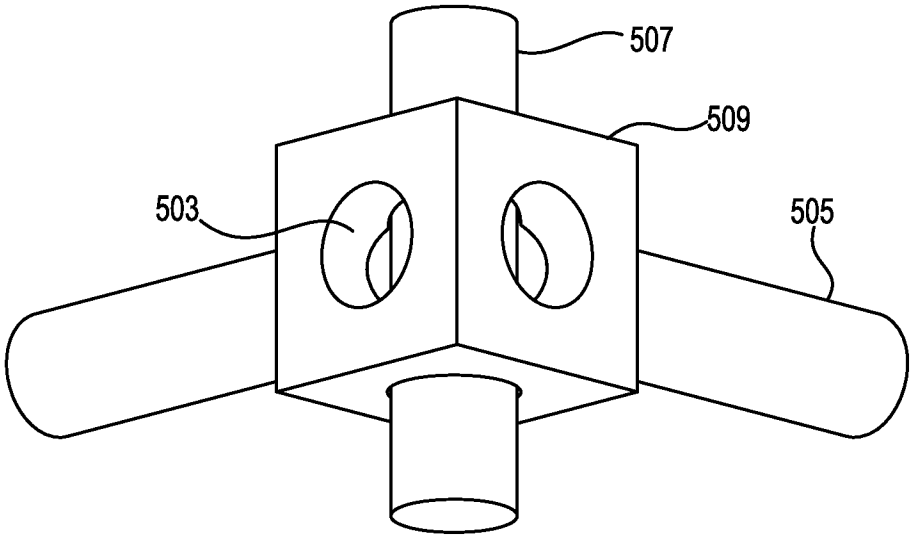
FIG. 5B is an illustration of the corner block from FIG. 5A with three rods from three adjoining panels (not shown) slideably engaged therethrough.
Figure 5A:
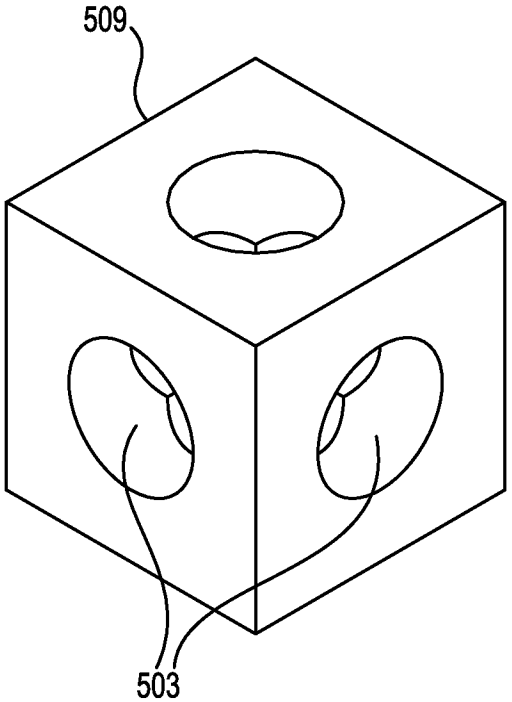
FIG. 5A is an illustration of an embodiment of a corner block.

FIG. 5A is an illustration of an embodiment of a corner block showing corner block 509 having six through holes 503. FIG. 5B is an illustration of the corner block from FIG. 5A with three rods from three adjoining panels (not shown) slideably engaged therethrough. FIG. 5B shows a portion of long rod 507 protruding through two opposite facing holes in corner block 509 in the vertical direction. The ends of two short rods 505 are shown slideably engaged into two perpendicular holes (behind corner block 509) but blocked by long rod 507 from protruding through corner block 509. Thus, longer rod 507 locks two shorter rods 505 into place in a fully assembled framework.

Figure 6:
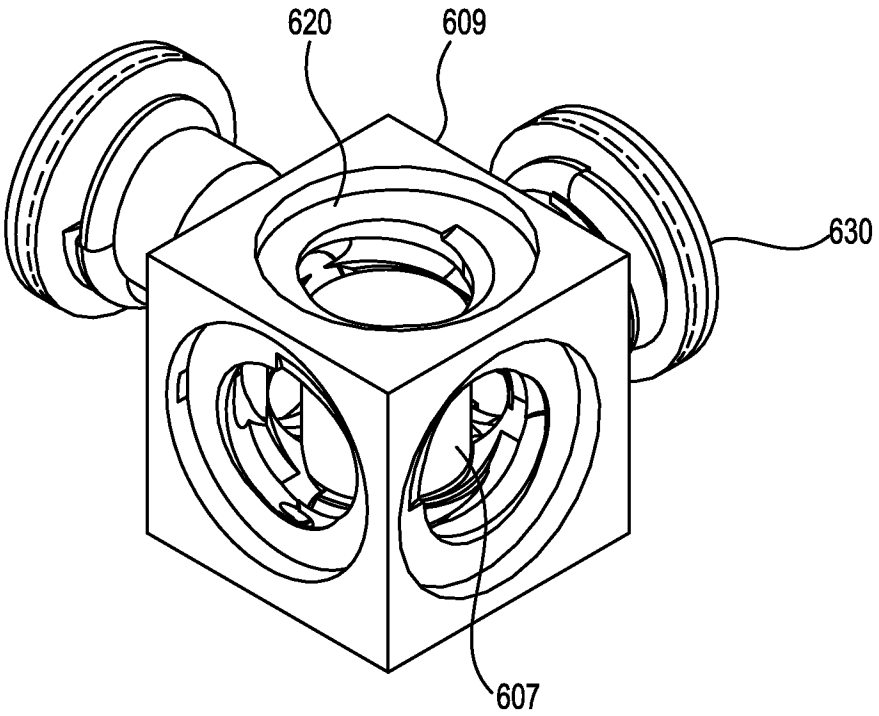
FIG. 6 is an illustration of an embodiment of a corner block with female threads and two plugs with male threads.

FIG. 6 is an illustration of an embodiment of a corner block with female threads and two plugs with male threads. Corner block 609 has holes through it in mutually perpendicular directions. Each hole 620 has a female screw thread. Also shown are two plugs 630 having complementary male screw threads that can be used to plug up some of holes 620 making a smooth surface. Also shown inside block 609 is a section of longer vertical rod 607. If desired, plug 630 can be a set screw which can be screwed into hold 620 (with female thread) far enough to lock up against vertical rod 607. In such embodiments, it may be useful to have a turning element such as a screwdriver slot, or knob to help tighten the set screw. Any other turning elements that will allow force to be exerted while turning set screw 630 are also within the scope of this disclosure.

Figure 7B:
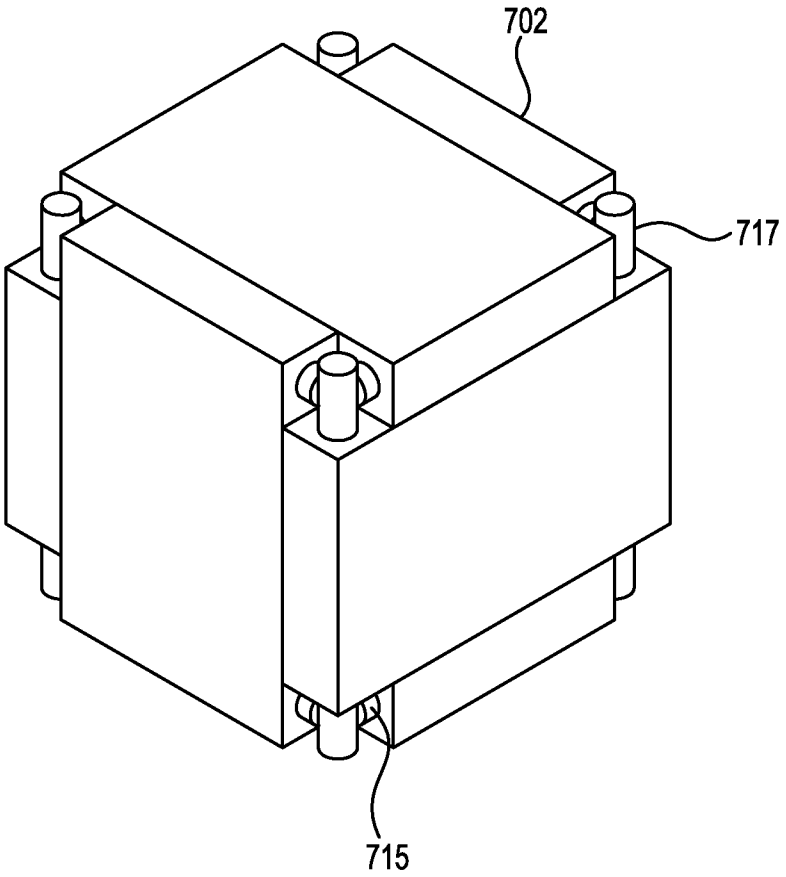
FIGS. 7A-7B are incomplete views of another embodiment of the provided storage containers.
Figure 7A:
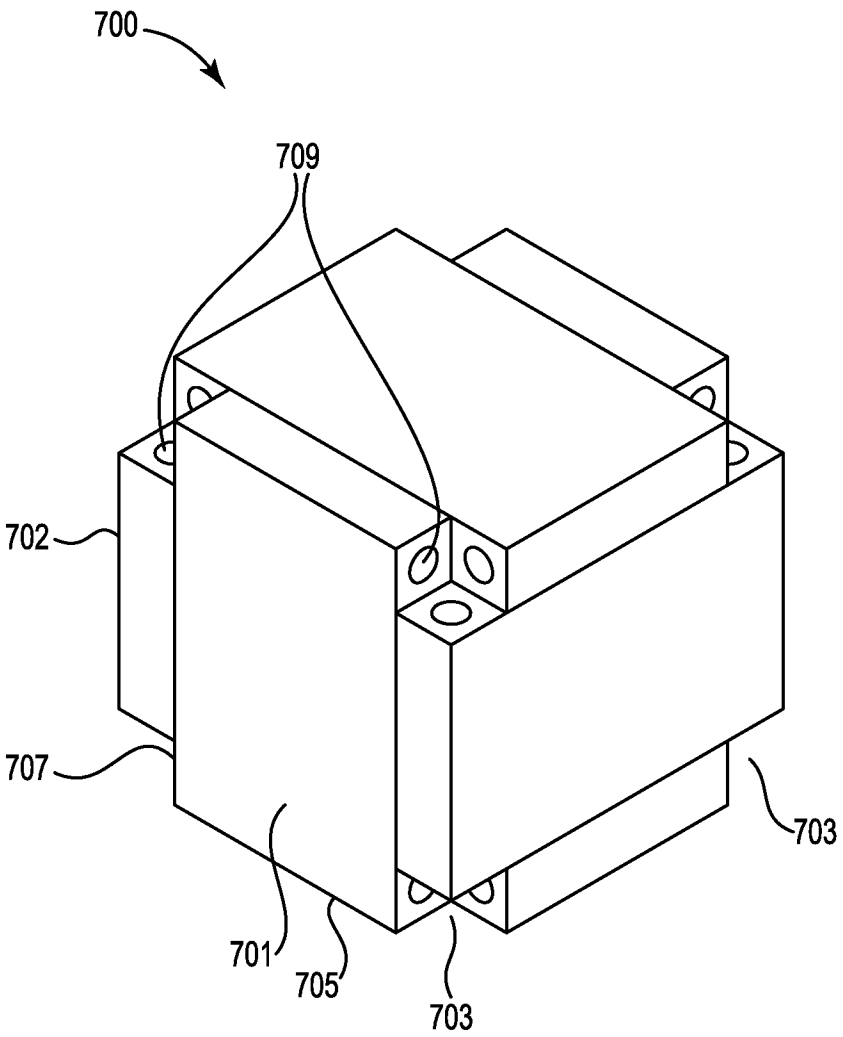

FIGS. 7A-7B are incomplete views of another embodiment of the provided storage containers. In this embodiment, all of the panels are congruent and have a rectangular outer surface. In this embodiment, the joining elements are the protruding long ends of each panel. FIG. 7A shows the provided storage container without corner blocks or rods. FIG. 7A shows six rectangular panels 701, each having a shorter edge (width) 705, and a longer edge (length) 707, assembled by alternating lengths and widths of each panel to form cubic structure, as shown, leaving notched corners 703. Each panel includes joining elements 702 that are the overlapping ends of each of the rectangular panels, as shown. Each joining element 702 has an orifice 709, in this embodiment, an elongated hole, that allows shorter rods 715 and longer rods 717, not shown in FIG. 7A, but shown in FIG. 7B, to protrude through each end.

Figure 7C:
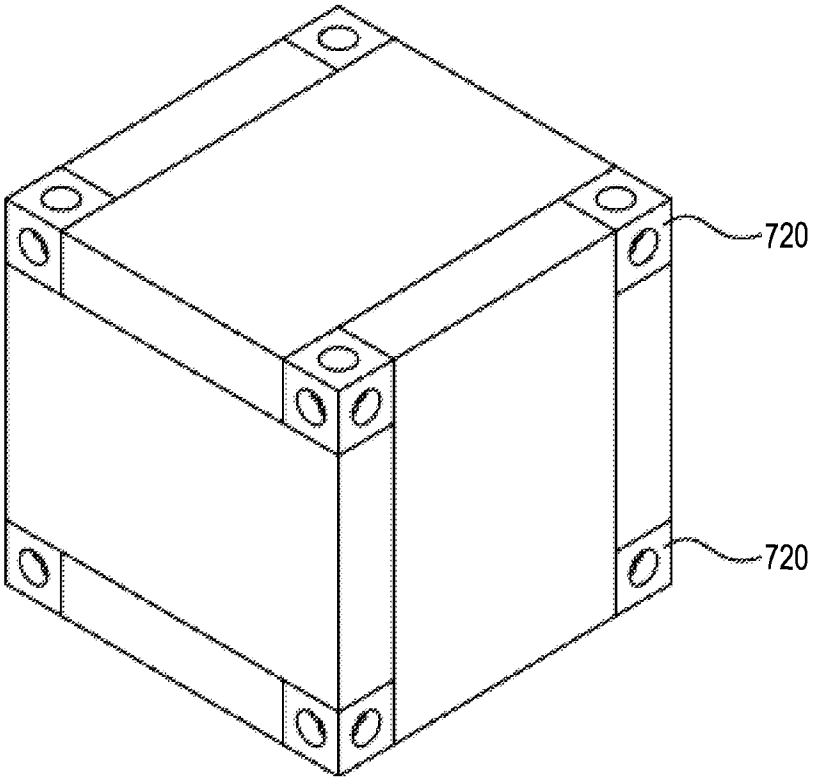
FIG. 7C is a complete view of the embodiment shown in FIGS. 7A and 7B.

FIG. 7B shows an incomplete view (corner blocks removed) of the same embodiment shown in FIG. 7A with rods engaging the joining elements. Four longer rods 717 extend the whole length of adjoining panel 702 (in a vertical position in the illustration as shown). Eight shorter rods 715 extend beyond the width of each panel as shown and are locked into place by being surrounded by longer rods at each notched corner 703. FIG. 7C shows the same embodiment illustrated in FIGS. 7A-B complete with corner blocks 720 in place in notches 703 and in which longer rods are visible in the corner blocks. In this embodiment, the provided storage container is in the shape of a cube and the interior storage space (inside the cube) is also in the shape of a cube.

Figure 8B:
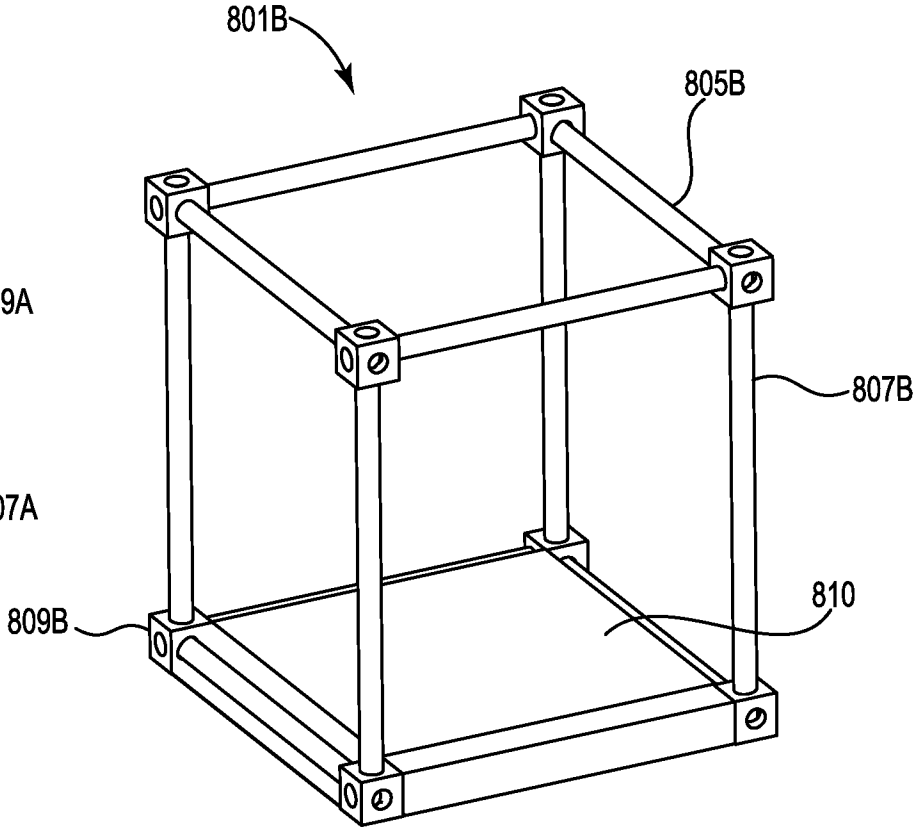
FIGS. 8A and 8B are illustrations of an embodiment of an assembled framework of rods and corner blocks that form a cubic frame.
Figure 8A:
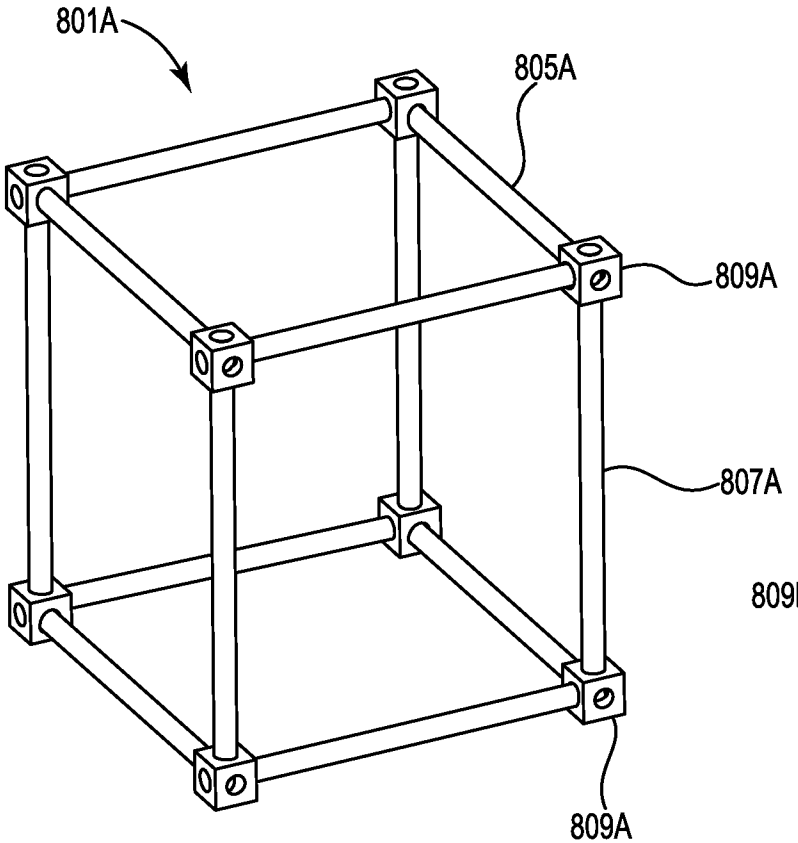

FIGS. 8A and 8B are illustrations of an embodiment of an assembled framework of rods and corner blocks that form a cubic frame. FIG. 8A is an illustration of the frame without any panels and FIG. 8B has one panel (the floor panel, in this case) installed. Framework 801A is shown in FIG. 8A. Framework 801A includes eight short rods 805A that are slideably engaged through adjacent corner blocks 809A but are not engaged far enough to block the four perpendicular longer rods 807A. Assembled framework 801A is strong and stable. It does not include any panels.

FIG. 8B is an illustration of the framework shown in FIG. 8A but is illustrated with one panel (a bottom panel). Framework 801B includes eight short rods 805B that are slideably engaged through adjacent corner blocks 809B but are not engaged far enough to block the four perpendicular longer rods 807B. Assembled framework 801B is strong and stable. Panel 810 is shown in place in the floor of assembled framework 801B. Panel 810 does not show all of its features in the illustration. Panel 810 and other panels can be attached to framework 801B as shown in FIGS. 1-4 if framework 801B is assembled while the panels are being assembled. However, it is contemplated that additional means of attaching panels such as 810 can be employed. In some embodiments, such as those illustrated schematically in FIG. 9, the panels can be applied after framework 810B is assembled and connected, for example, by clamps, straps, clips, sealants, and permanent or removable adhesives.

Figure 9:
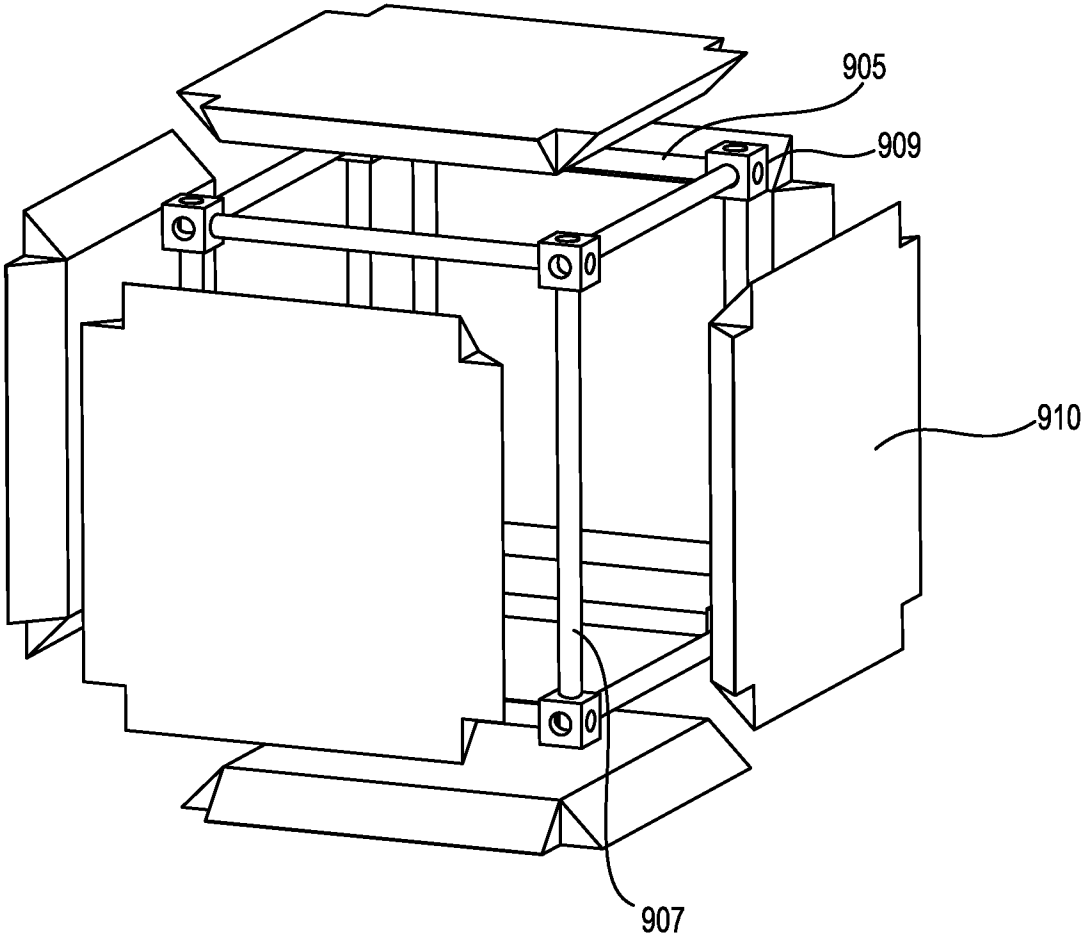
FIG. 9 is an exploded illustration of how six panels (shown without detail) can be mounted on the assembled framework shown in FIG. 8A.

FIG. 9 is an exploded illustration showing how six panels (shown without detail) can be mounted on the assembled framework shown in FIG. 8A to form a provided modular storage container. The framework is assembled from short rods 905, long rods 907, corner blocks 909, and panels 910.

Figures 10A, 10B:
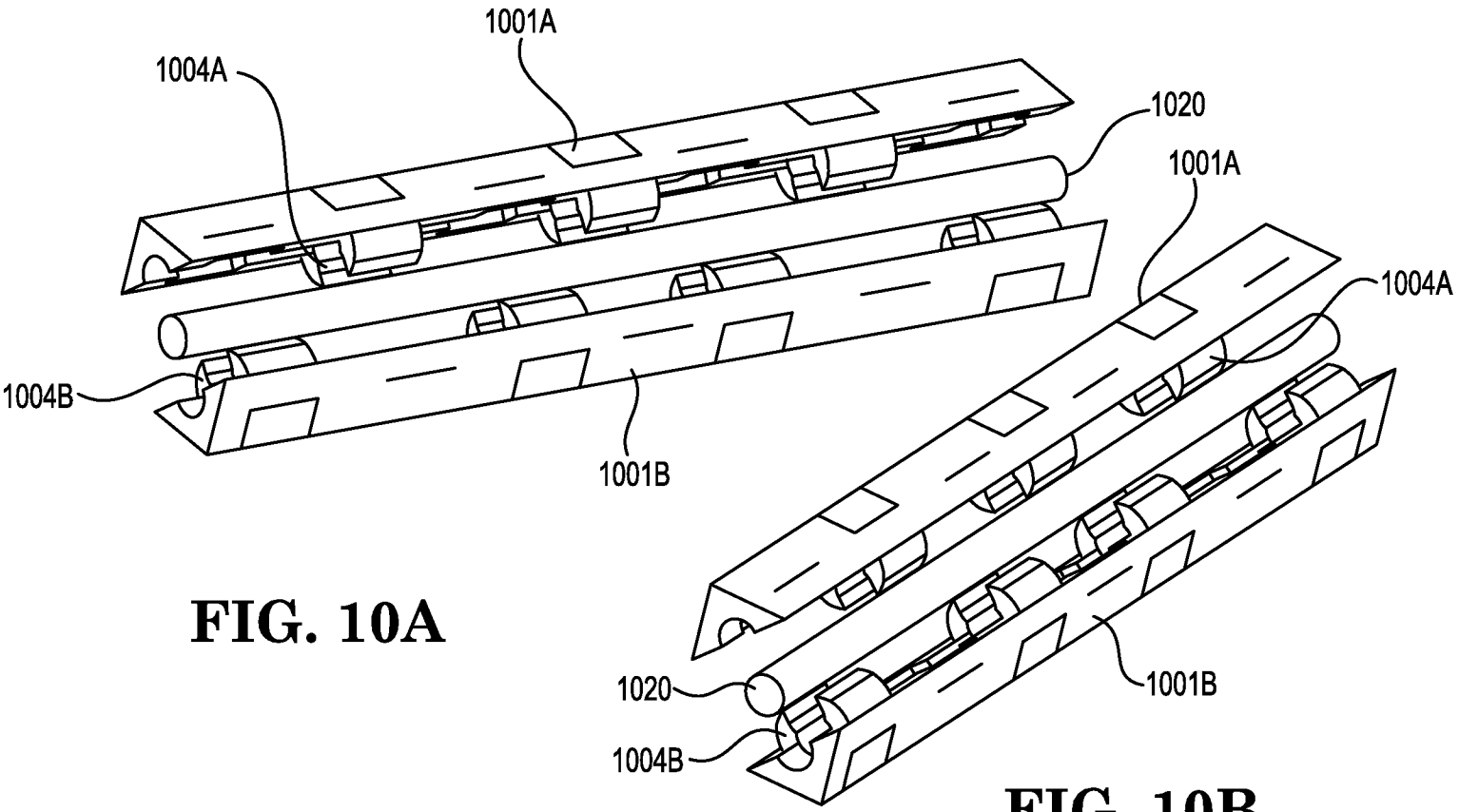
FIGS. 10A and 10B are two different perspective partial views showing the use of joining elements (in this embodiment, snap clamps) on adjacent panels and their attachment to rods of an assembled framework.

FIGS. 10A and 10B are two different perspective partial exploded views showing the use of joining elements (in this embodiment, snap clamps) on adjacent panels and their attachment to rods of an assembled framework. Both FIGS. 10A and 10B are views of the same embodiment. Joining elements 1004A on edge 1001A of one panel and joining elements 1004B on edge 1001B of an adjacent panel are shown in position to engage rod 1020. Rod 1020 is part of a framework as shown FIGS. 8 and 9. Joining elements 1004A and 1004B are embodied as snap clamps that can engage rod 1020 and can lock in place or snap together to attach adjacent panels.

Figure 11B:
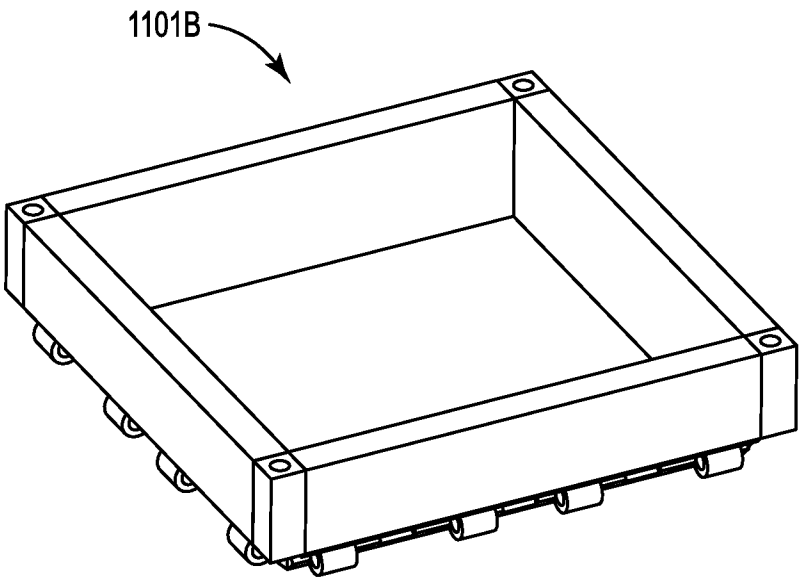
FIG. 11B is an illustration similar to that that shown in FIG. 11A with only four edges on the bottom having arrays of protrusions and receptacles.
Figure 11A:
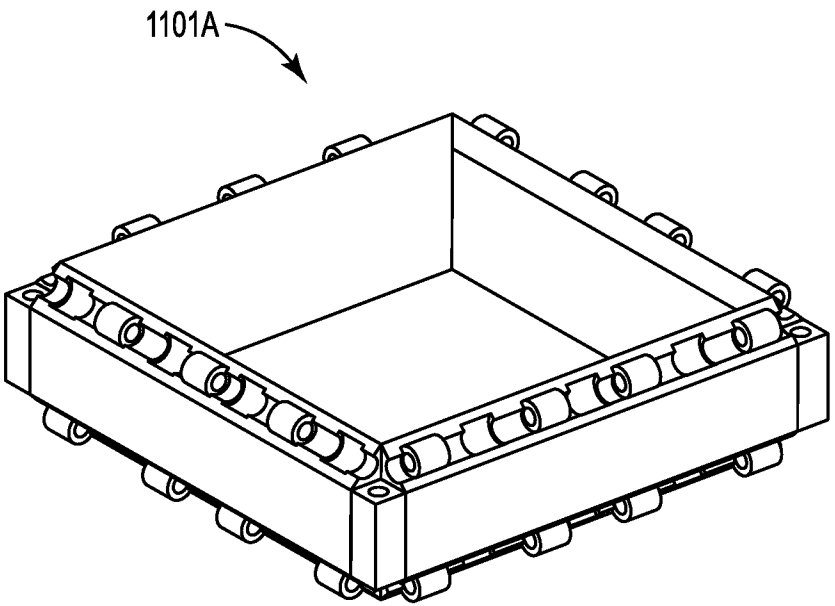
FIG. 11A is an illustration of an embodiment of a frame that includes edges with notched ends (each containing a corner block) and having four edges on the top and four edges on the bottom having arrays of male joining protrusions and female receptacles arranged along all edges.

FIG. 11A is an illustration of an embodiment of frame 1101A that includes edges with notched ends (each containing a corner block) and having four edges on the top and four edges on the bottom having arrays of joining elements along all edges. FIG. 11B is an illustration similar to that that FIG. 11A but only having one side of the frame with joining elements. An embodiment such as that shown in FIG. 11B can be useful for placing on a flat surface or for securing a last panel to it. Additionally, frames 1101A or 1101B can be used to extend the height or width of provided panels to accommodate storage of items with oversized dimensions.

Figure 12:
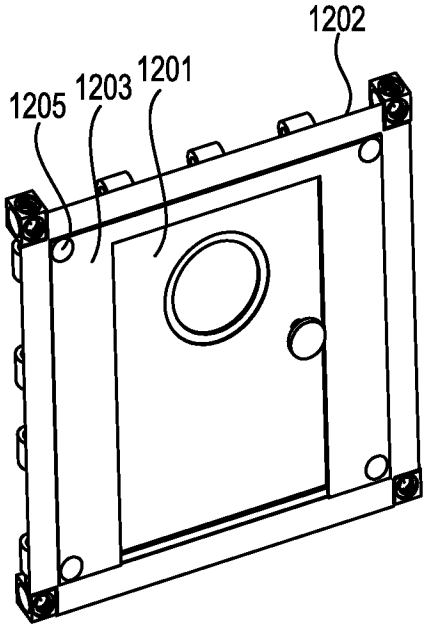
FIG. 12 is an illustration of an embodiment of a provided panel that includes a door therewithin.

FIG. 12 is an illustration of an embodiment of a provided panel that includes a door therewithin. Door 1201 is connected to insert 1203 that is attached to a provided frame 1202 with attachment means 1205. Attachment means can include rivets, screws, bolts, or any type of mechanical fastener.

Figure 13:
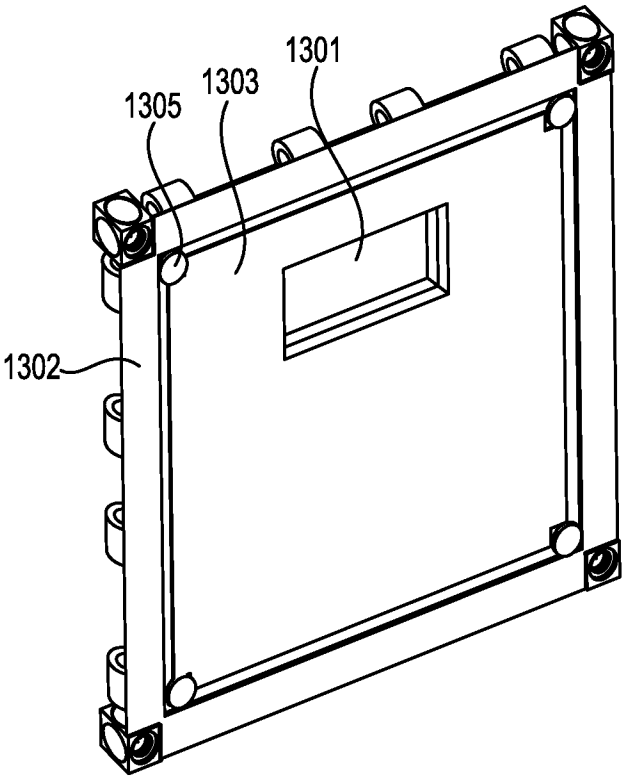
FIG. 13 is an illustration of an embodiment of a provided panel that includes a window therewithin.

FIG. 13 is an illustration of an embodiment of a provided panel that includes a window therewithin. Window 1301 is embedded into insert 1303 that is attached to a provided frame 1302 with attachment means 1305. Attachment means can include rivets, screws, bolts, or any type of mechanical fastener.

Figure 14:
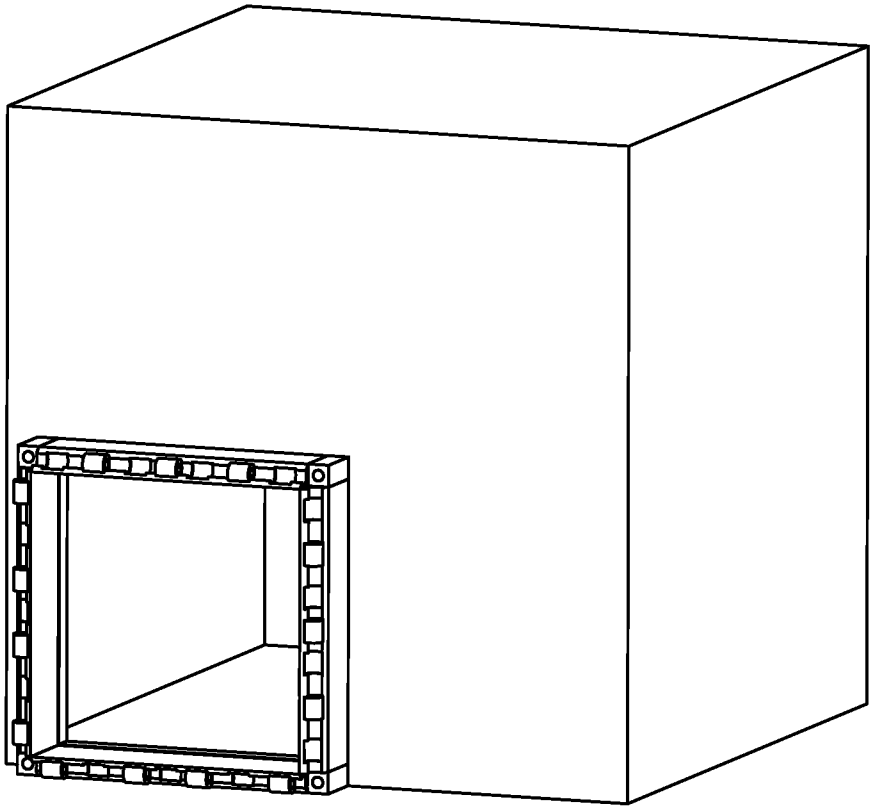
FIG. 14 is an illustration of a conventional storage container having a side that includes a frame useful for connecting or assembling a modular storage container thereto.

FIG. 14 is an illustration of an embodiment showing a conventional storage container having a side that includes a frame useful for connecting or assembling a modular storage container thereto.

Figure 15:
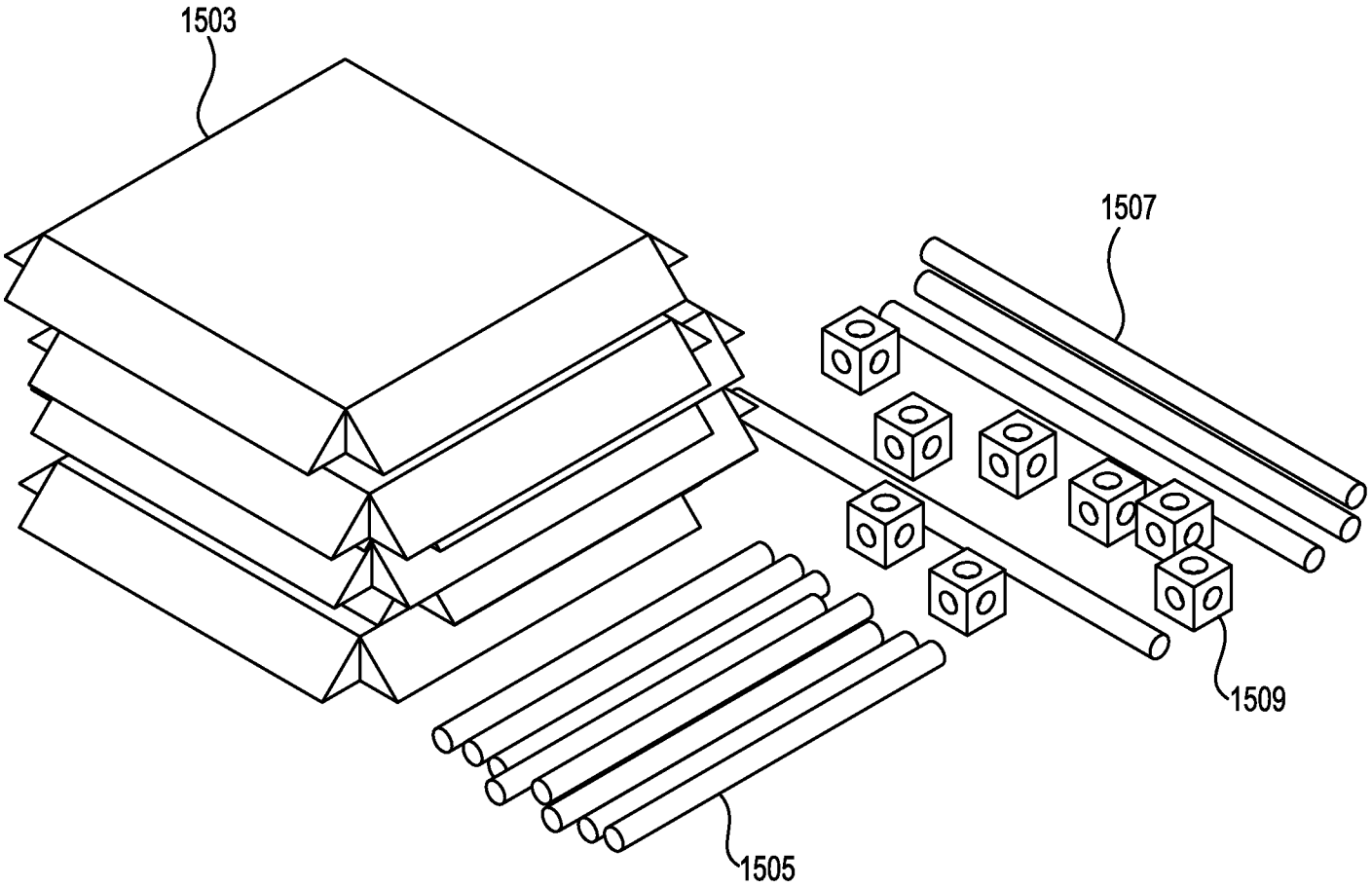
FIG. 15 is an embodiment of a provided kit.

FIG. 15 is an embodiment of a provided kit. The provided kit includes six panels 1503 (shown without detail), twelve rods, including eight shorter rods 1505 and four longer rods 1507. The provided kit also includes eight corner blocks.

Various modifications and alterations to this invention will become apparent to those skilled in the art without departing from the scope and spirit of this invention. It should be understood that this invention is not intended to be unduly limited by the illustrative embodiments and examples set forth herein and that such examples and embodiments are presented by way of example only with the scope of the invention intended to be limited only by the claims set forth herein as follows. All references cited within this document are hereby incorporated by reference in their entirety.

I claim:

1. A modular storage container system comprising one or more modular storage containers, each modular storage container comprising:

a multitude of panels, each panel comprising edges; joining elements affixed proximate to the edges;

a multitude of rods slideably engaging the joining elements; and at least one corner block having holes through adjacent faces configured to engage the ends of the rods joining adjacent panels in a substantially perpendicular alignment wherein the joining elements comprise an array of male joining protrusions and female receptacles arranged along the at least one edge of each panel, wherein each male joining structure comprises an orifice, and wherein the array of male joining protrusions and female receptacles on the edge of each panel is interlaced with an array of complimentary female receptacles and male joining protrusions of an edge of an adjacent panel.

2. A modular storage container system according to claim 1, wherein at least one of the multitude of panels comprises notched ends.

3. A modular storage container system according to claim 1, wherein the multitude of panels comprise the faces of a rectangular polyhedron.

4. A modular storage container system according to claim 2, wherein the corner block is engaged in the notched ends of adjacent panels.

5. A modular storage container system according to claim 4, further comprising at least one plug element inserted into the hole of at least one corner block.

6. A modular storage container system according to claim 1, wherein two adjacent panels are chamfered to fit perpendicular to each other when their respective arrays of complementary male protrusions and female receptacles are engaged and interlaced.

7. A modular storage container system according to claim 1, wherein the corner block comprises set screw elements.

8. A modular storage container system according to claim 1, wherein one ofthe multitude of panels comprises a door or a window.

9. A modular storage container system according to claim 2, wherein a multitude of rectangular polyhedrons are stacked together to form a storage assembly.

10. A modular storage container system according to claim 1, wherein all of the multitude of panels are congruent.

11. A modular storage container system according to claim 1, comprising at least twelve rods which include at least four longer rods and eight shorter rods.

12. A modular storage container system according to claim 11, wherein the four longer rods are parallel and perpendicular to the eight shorter rods and wherein the four longer rods lock in the eight shorter rods on each end of the shorter rods.

13. A modular storage container system according to claim 5, wherein the plug comprises a turning element.

14. A modular storage container system according to claim 1, wherein at least one rod has male screw threads on at least one end and at least one corner block has at least one female screw thread.

15. A kit comprising:

at least six panels, each panel comprising edges with joining element, at least twelve rods configured to be slideably engaged through the orifices of the joining elements on adjacent panels when interlaced; and at least eight corner blocks, each corner block comprising a cube with holes through adjacent faces configured to engage the ends of the rods joining adjacent panels in a substantially perpendicular alignment.

16. A kit according to claim 15, wherein at least one of the multitude ofpanels comprises notched ends.

17. A kit according to claim 15, wherein the joining elements comprise an array of male joining protrusions and female receptacles arranged along the at least one edge of each panel, wherein each male joining structure comprises an orifice, and wherein the array of male joining protrusions and female receptacles on the edge of each panel is interlaced with an array of complimentary female receptacles and male joining protrusions of an edge of an adjacent panel.

18. A method of using a modular storage container system comprising:

providing a modular storage container system, the storage system comprising: one or more modular storage containers, each modular storage container comprising:

a multitude of panels, each panel comprising edges, wherein at least one edge comprises joining elements;

a multitude of rods threaded through the orifices of the interlaced male joining protrusions of adjacent panels; and a corner block comprising holes through adjacent faces configured to engage the ends of the rods of adjoining adjacent panels in substantially perpendicular alignment;

wherein the joining elements comprise an array of male joining protrusions and female receptacles arranged along the at least one edge of each panel;

wherein each male joining structure comprises an orifice; and wherein the array of male joining protrusions and female receptacles on the edge of each panel is interlaced with an array of complimentary female receptacles and male joining protrusions of an edge of an adjacent panel; and assembling the modular storage system.

19. A method of using a modular storage container system according to claim 18, wherein assembling comprises:

interlacing the array of male joining protrusions and female receptacles on adjacent edges of each panel;

inserting rods through the orifices of each of the male joining protrusions at the edge of each panel; and inserting the ends of each rod in a corner block so as to form a rectangular polyhedron.

* * * * *